United States Patent [19]

Hui et al.

[11] Patent Number: 4,932,556

[45] Date of Patent: Jun. 12, 1990

[54] LINER WITH TEAR LINES FOR RECTANGULAR-BOTTOMED CONTAINER

[75] Inventors: Wai K. Hui, Delta; William L. Hui, Richmond, both of Canada

[73] Assignee: Flexcan Packaging Inc., British Columbia, Canada

[21] Appl. No.: 378,131

[22] Filed: Jul. 11, 1989

[51] Int. Cl.[5] ..... B65D 77/38; B65D 30/16

[52] U.S. Cl. ..... 220/403; 220/404; 220/406; 206/554; 206/610; 383/2; 383/4; 383/122

[58] Field of Search ..... 220/403, 404, 405, 406; 206/554, 610, 620; 383/122, 4, 2; 229/DIG. 13

[56] References Cited

U.S. PATENT DOCUMENTS

| | | | |
|---|---|---|---|
| 2,127,646 | 8/1938 | Luery | 206/620 |
| 2,821,337 | 1/1958 | Morgan | 383/122 |
| 3,065,895 | 11/1962 | Lipschutz et al. | 220/403 |
| 3,136,475 | 6/1964 | Geimer | 383/122 |
| 3,227,137 | 1/1966 | Goldman et al. | 220/404 |
| 3,310,265 | 3/1967 | Mulloy | 220/404 |
| 3,380,646 | 4/1968 | Doyen et al. | 383/122 |
| 3,549,451 | 12/1970 | Kugler | 383/122 |
| 3,684,155 | 8/1972 | Smith | 220/404 |
| 3,684,156 | 8/1972 | Fettinger | 206/610 |
| 3,980,225 | 9/1976 | Kan | 383/122 |
| 4,205,869 | 6/1980 | Mathis | 220/404 |
| 4,366,916 | 1/1983 | Guido et al. | 220/404 |
| 4,375,258 | 3/1983 | Crayne | 206/620 |
| 4,449,279 | 5/1984 | Takeuchi | 383/4 |
| 4,524,870 | 6/1985 | Roccaforte | 206/620 |
| 4,618,992 | 10/1986 | La Grotteria | 383/4 |
| 4,623,111 | 11/1986 | Prader | 220/404 |
| 4,702,377 | 10/1987 | Grone | 220/405 |
| 4,777,054 | 10/1988 | Greenhouse | 206/620 |
| 4,819,806 | 4/1989 | Pistner | 206/554 |

*Primary Examiner*—Stephen Marcus
*Assistant Examiner*—S. Castellano
*Attorney, Agent, or Firm*—Barrigar & Oyen

[57] ABSTRACT

A liner for lining a generally rectangular-bottomed container. First and second outer faces of the liner are connected together along opposed first and second edges and are separable from one another along a top edge extending between the first and second edges. An inwardly gusseted bottom face of the liner extends between opposed bottom portions of the first and second edges. First and second lines of weakness are spaced inwardly from the first and second edges and extend from the top edge, across the outer faces, into the inwardly gusseted bottom face.

16 Claims, 3 Drawing Sheets

LINER WITH TEAR LINES FOR RECTANGULAR-BOTTOMED CONTAINER

FIELD OF THE INVENTION

This application pertains to a plastic liner for lining a rectangular-bottomed container. The liner's shape conforms to that of the container. The liner has a series of flaps which may be folded over one another to neatly enclose fish roe or other material placed in the lined container.

BACKGROUND OF THE INVENTION

Fish roe is a delicacy in countries like Japan, whose consumers pay high prices for top quality roe. The Japanese are particularly discriminating in relation to foodstuffs such as roe, typically insisting that the roe be as fresh as possible, and that it be attractively packaged. This attention to detail applies not only to the manner in which the roe is presented to the ultimate consumer, but extends back through the chain of production, to the source from which the roe is obtained.

Much of the roe sold in Japan is obtained from salmon and herring caught off the west coast of North America by the fishing fleets of Alaska, British Columbia and Washington. The roe is extracted from the fish and packaged in plants situate in these jurisdictions, from which it is shipped to Japan.

Typically, the roe leaves the processing plant in generally rectangular, flat-bottomed plastic containers. The containers are lined with plastic film before the roe is placed in the container. The film shields the roe from the inner walls of the container and facilitates extraction of the roe from the container. Drainage holes in the film allow fluids to escape into the bottom of the container, which supports the roe-containing liner above a fluid collection region.

Initially, conventional plastic bags were used to line the containers. The bag was placed in the container and filled with a prescribed amount of roe. The top portion of the bag was then gathered (i.e. crushed) together, sealed to close the bag, and flattened down atop the roe. The container's lid was then fastened and the filled container shipped to Japan. However, the Japanese roe importers objected to the unsightly appearance of the flattened, crushed top portion of the bag, which was the first thing they saw when they removed the lid from the container.

To eliminate the unsightly appearance aforesaid, roe processors began using flat strips of plastic film to line the containers. Two strips of appropriate sizes were laid crosswise atop one another and fitted into the container, leaving the ends of the strips protruding over the sides of the container. The roe was placed in the container, atop the overlaid strips, and the protruding ends were then folded over and laid flat atop the roe to give a neat, finished look to the packaged product. Unfortunately, this proved to be quite labour intensive, due the difficulty of maintaining the container and the strips in alignment with one another so that equal lengths of each strip protruded from the container for folding over atop the roe. The problem was exacerbated by the industry practice of printing, on one end of one of the two strips, the trade-mark of the Japanese roe importer for whom the roe was destined. This end was folded and laid atop the roe last, so that the trade-mark appeared prominently when the container lid was removed. However, if the strips were not properly aligned, the trade-mark was off-centre, which troubled the Japanese importer.

The present invention overcomes the foregoing problems by providing a unitary liner having a lower compartment shaped to conform to the interior of the container, and upper flaps which may be folded flat to close the compartment, giving a neat, finished appearance. The lower portion of the unitary liner can easily be positioned squarely within the container and remains in position, so that the upper portions are properly aligned with the container when they are laid flat atop the roe.

SUMMARY OF THE INVENTION

In accordance with the preferred embodiment, the invention provides a liner for lining a generally rectangular-bottomed container. In its laid-flat configuration, the liner has first and second outer faces which are connected together along opposed first and second edges and separable from one another along a top edge extending between the first and second edges. An inwardly gusseted bottom face of the liner extends between opposed bottom portions of the first and second edges. First and second lines of weakness are spaced inwardly from the first and second edges and extend from the top edge, across the outer faces.

Opposed edges of the bottom face are connected to the bottom portions of the first and second edges respectively. The first and second outer faces are connected to the bottom face along regions which extend diagonally from the first and second edges respectively, in a direction away from the top edge. A third line of weakness extends between the first and second lines of weakness, beneath the top edge.

In its opened configuration, the liner has a bottom face having first, second, third and fourth edges; and, first, second, third and fourth side faces which are connected along and extend upwardly from the first, second, third and fourth edges respectively. A lower portion of the first face is connected to adjacent lower portions of the second and fourth faces respectively, the remaining portion of the first face being free of connection to the second, third or fourth faces. The lower portion of the second face is further connected to an adjacent lower portion of the third face, the remaining portion of the second face being free of connection to the first, third or fourth faces. The lower portion of the third face is further connected to an adjacent lower portion of the fourth face, the remaining portion of the third face being free of connection to the first, second, or fourth faces. The remaining portion of the fourth face is also free of connection to the first, second or third faces.

DETAILED DESCRIPTION OF THE PREFERRED EMBODIMENT

Figure 1:
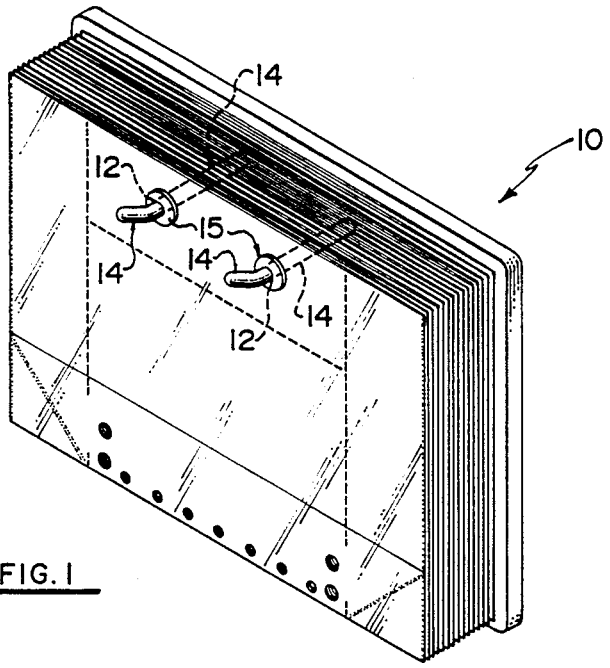
FIG. 1 is an oblique perspective view of a wicket of liners produced in accordance with the preferred embodiment of the invention.

FIG. 1 illustrates a "wicket" 10 of liners produced in accordance with the invention. Wicket 10 comprises a plurality of individual liners formed of thin sheet plastic material. The liners are laid flat atop one another to form wicket 10 by aligning holes 12 punched near the top of each liner. Wicket 10 may be mounted for easy handling by passing a suitable support hangar 14 through holes 12. Retaining gaskets 15 or similar fasteners are placed over hangar 14 to hold wicket 10 in place. If desired, the individual liners comprising wicket 10 may be fastened together by hot needle punching holes 12 through the entire plurality of liners.

Figure 2:
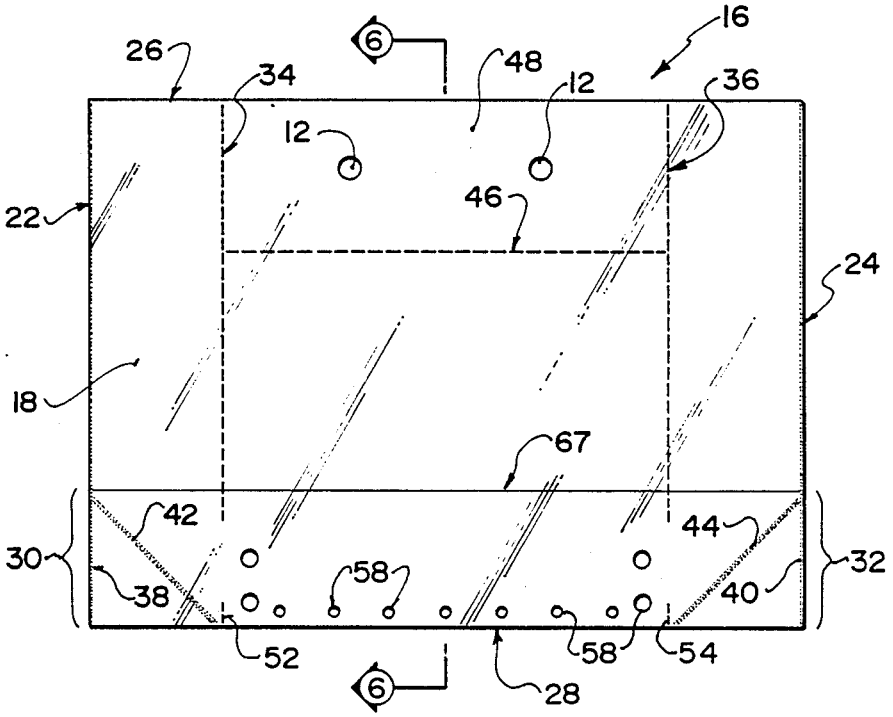
FIG. 2 is a front plan view showing the laid-flat configuration of one of the liners comprising the wicket of FIG. 1, the liner being shown as though it were formed of transparent material.
Figure 3:
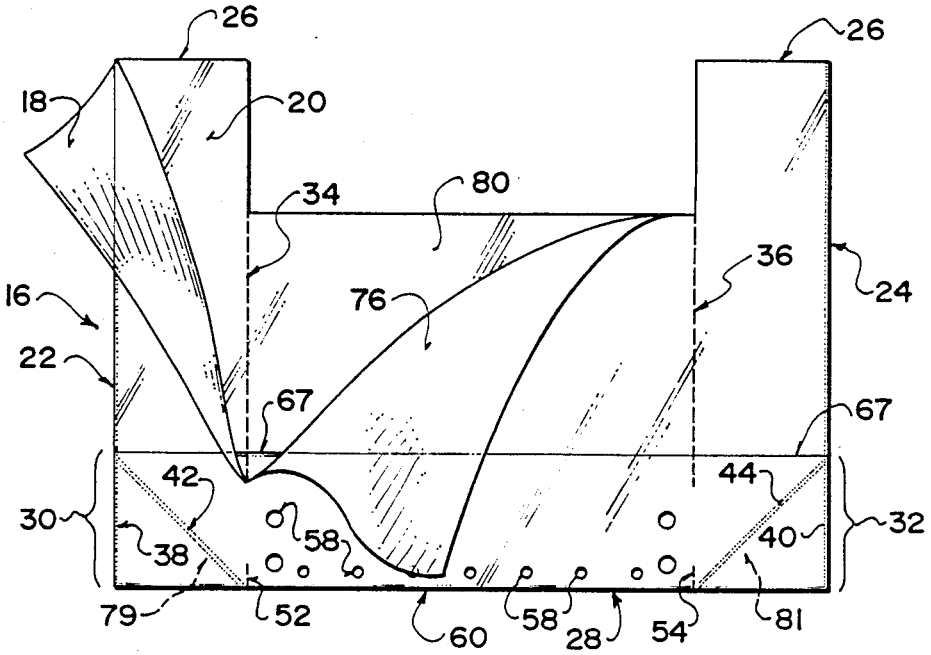
FIG. 3 is similar to FIG. 2, but shows the liner as it appears after removal from the wicket, and shows portions of one of the liner's outer faces peeled forward to expose the other outer face.
Figure 4:
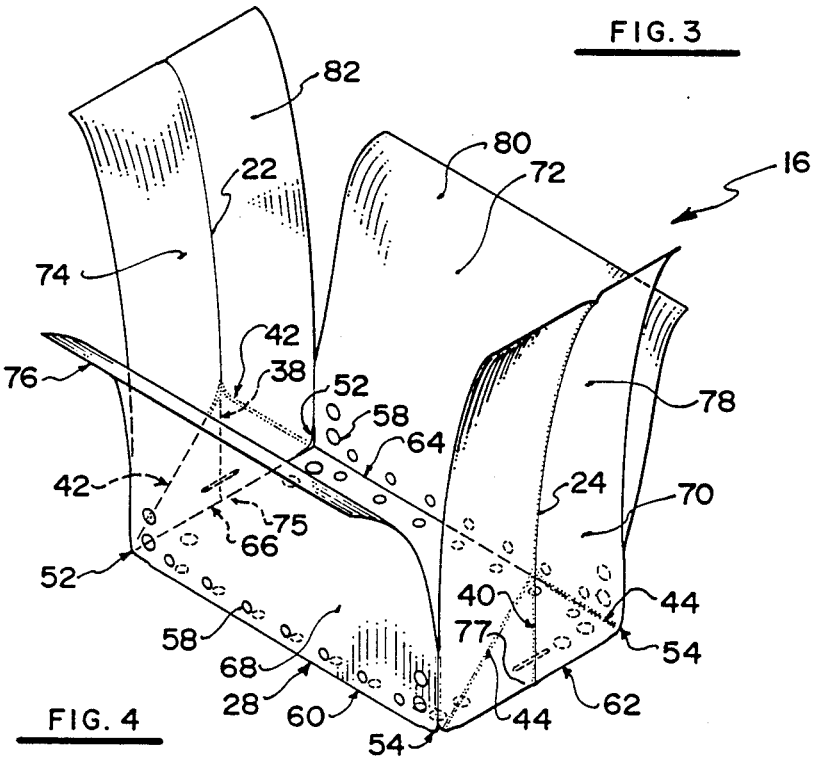
FIG. 4 shows the liner's opened configuration, with the liner flaps protruding substantially vertically from the lower portions, and showing the liner as though it were formed of opaque material.
Figure 5:
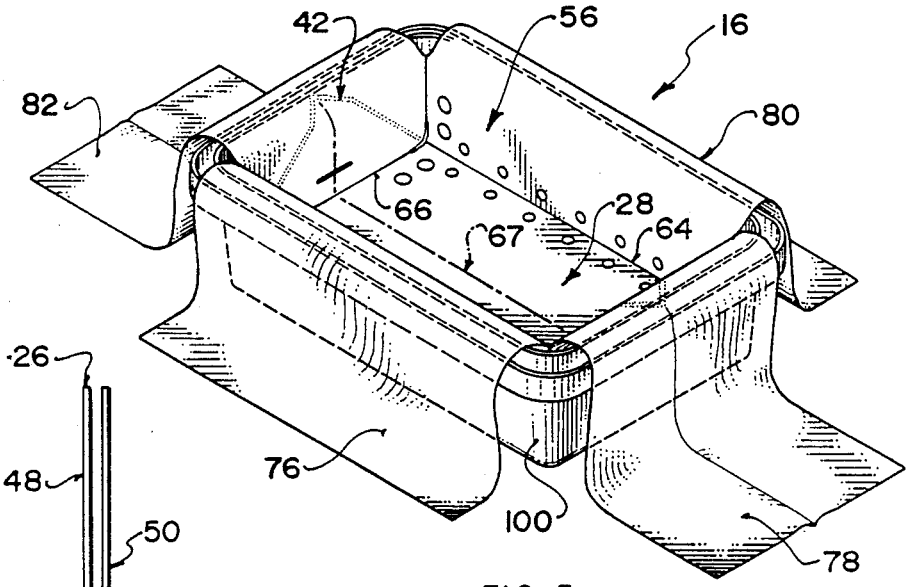
FIG. 5 shows the opened liner of FIG. 4 inserted into a container.
Figure 6:
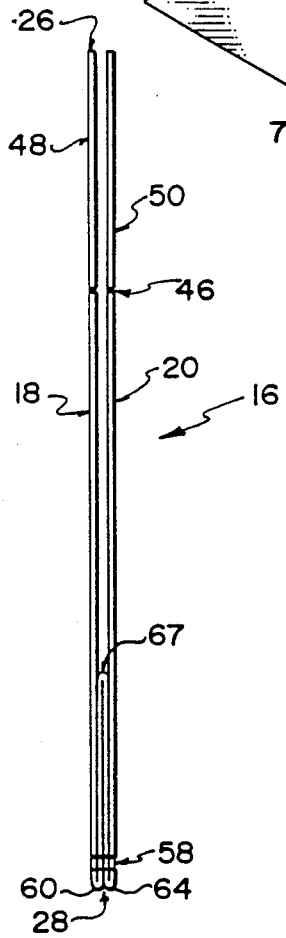
FIG. 6 is a cross-sectional view, of exaggerated thickness, taken with respect to line 6—6 of FIG. 2; and, FIG. 7 shows the closed liner within the container, with the container lid removed.
Figure 7:
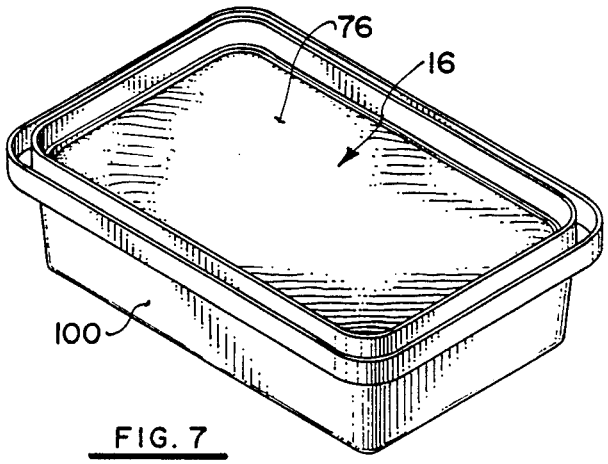

An individual liner 16 will now be described with reference to FIGS. 2 through 7. FIGS. 2, 3 and 6 show liner 16 in its laid-flat configuration (i.e. the configuration of each of the plurality of liners comprising wicket 10 ). FIGS. 4, 5 and 7 show liner 16 in its opened configuration.

In its laid-flat configuration, liner 16 has a first outer face 18 and a second, opposed outer face 20 (best seen in FIG. 3). First and second outer faces 18, 20 are connected together by welding along their opposed first and second edges 22, 24. Outer faces 18, 20 are left unconnected (i.e. outer faces 18, 20 are separable from one another) along a top edge 26 which extends between first and second edges 22, 24.

An inwardly gusseted bottom face 28 extends between opposed bottom portions 30, 32 of first and second edges 22, 24. First and second lines of weakness 34, 36 (i.e. perforations) are spaced inwardly from first and second edges 22, 24 and extend from top edge 26, across outer faces 18, 20 into inwardly gusseted bottom face 28.

Opposed edges 38, 40 of bottom face 28 are respectively connected, by welding, to bottom portions 30, 32 of first and second edges 22, 24. First and second outer faces 18, 20 are further connected to bottom face 28 by welding along regions 42, 44 which extend diagonally from first and second edges 22, 24 respectively, in a direction away from top edge 26. A third line of weakness 46 (FIG. 2) extends between first and second lines of weakness 34, 36, beneath top edge 26.

In operation, liner 16 is removed from wicket 10 by grasping liner 16 along first and second edges 22, 24 and tearing along first, second and third lines of weakness 34, 36 and 46. This separates liner 16 from the support structure comprising panels 48, 50 (FIGS. 2 and 6) which remain suspended on hangar 14 and are later discarded. If necessary, any portions of outer faces 18, 20 which remain frangibly connected along first or second lines of weakness 34, 36 are separated from one another by completely tearing along the lines of weakness into bottom face 28. Liner 16 is then opened into the configuration shown generally in FIG. 4 by thrusting the hands between faces 18, 20 and spreading the two faces apart.

Welded regions 42, 44 act in conjunction with fourth and fifth lines of weakness 52, 54 to help shape the lower portion of liner 16 into a generally rectangular, flat-bottomed compartment 56 for containing fish roe or other material. More particularly, fourth and fifth lines of weakness 52, 54 are respectively longitudinally aligned with first and second lines of weakness 34, 36 and extend upwardly a short distance through the lowermost portions of each of outer faces 18, 20 and bottom face 28, frangibly connecting those faces. As may be seen in FIG. 4, fourth and fifth lines of weakness 52, 54 form the lower corners of compartment 56 when liner 16 is in its opened configuration. Welded regions 42, 44 assist in maintaining the corners relatively square. Drainage holes 58 are punched through outer faces 18, 20 and bottom face 28, near the edges at which the faces intersect, to provide drainage around the lower periphery of compartment 56.

Bottom face 28 of liner 16 has first, second, third and fourth edges 60, 62, 64 and 66 which are best seen in the opened configuration of liner 16 shown in FIG. 4. When liner 16 is in its laid-flat configuration, bottom face 28 is folded inwardly (i.e. gusseted as aforesaid) along axis 67, which extends between second and fourth edges 62, 66 parallel to first and third edges 60, 64. When liner 16 is opened as aforesaid, outer faces 18, 20 form first, second, third and fourth side faces 68, 70, 72 and 74 which are respectively connected to and extend upwardly from first, second, third and fourth edges 60, 62, 64 and 66.

When liner 16 is in its laid-flat configuration, second side face 70 is folded outwardly from first and third side faces 68, 72 along second edge 24, which forms a central axis of second side face 70. Fourth side face 74 is similarly folded outwardly from first and third side faces 68, 72 along first edge 22, which forms a central axis of fourth side face 74 when liner 16 is in its laid-flat configuration. It will be understood that, when liner 16 is in its laid-flat configuration, first line of weakness 34 frangibly connects first and third side faces 68, 72 to fourth side face 74 and further frangibly connects a first portion 75 of bottom face 28 to fourth side face 74; and, second line of weakness 36 frangibly connects first and third side faces 68, 72 to second side face 70 and further frangibly connects a second portion 77 of bottom face 28 to second side face 70.

A first extension 79 of bottom face 28 protrudes beyond fourth edge 66, in the laid-flat configuration of liner 16, and is folded inwardly along axis 67, within outwardly folded fourth side face 74. Similarly, second extension 81 of bottom face 28 protrudes beyond second edge 62, in the laid-flat configuration of liner 16, and is folded inwardly along axis 67, within outwardly folded second side face 70. It will thus be understood that welded regions 42, 44 mentioned above each comprise two separate regions which overlap one another when liner 16 is in its laid-flat configuration. More particularly, region 42 comprises a first region which connects first extension 79 to the lower folded half of fourth side face 74 and extends diagonally downwardly from the folded axis (i.e. first side 22) of fourth side face 74 toward first edge 60; and, a second, overlapping region which connects first extension 79 to the upper folded half of fourth side face 74 and extends diagonally downwardly from the folded axis (i.e. first side 22) of fourth side face 74 toward third edge 64. The first and second regions form an inverted "V" when liner 16 is in its opened configuration. Similarly, region 44 comprises a first region which connects second extension 81 to the lower folded half of second side face 70 and extends diagonally downwardly from the folded axis (i.e. second side 24) of second side face 70 toward first edge 60; and, a second, overlapping region which connects second extension 81 to the upper folded half of second side face 70 and extends diagonally downwardly from the folded axis (i.e. second side 24) of second side face 70 toward third edge 64.

Lower portions of first, second, third and fourth side faces 68, 70, 72 and 74 (which lower portions are located between bottom portions 30, 32 of first and second edges 22, 24 when liner 16 is in its laid-flat configuration) frame compartment 56. The lower portion of first face 68 is connected to the adjacent lower portions of second and fourth faces 70, 74 respectively, the remaining portion of first face 68 constituting a first flap 76 which is free of connection to second, third or fourth faces 70, 72 or 74. The lower portion of second face 70 is further connected to an adjacent lower portion of third face 72, the remaining portion of second face 70 constituting a second flap 78 which is free of connection to first, third or fourth faces 68, 72 or 74. The lower portion of third face 72 is further connected to an adjacent lower portion of fourth face 74, the remaining portion of third face 72 constituting a third flap 80 which is free of connection to first, second, or fourth faces 68, 70 or 74. The remaining portion of fourth face 64 similarly constitutes a fourth flap 82 which is free of connection to first, second or third faces 68, 70 or 72.

Opened liner 16 is laid within container 100, as shown in FIG. 5, with flaps 76, 78, 80 and 82 protruding over the sides of the container. Fish roe or other material is then placed within compartment 56 and flaps 76, 78, 80 and 82 are then sequentially folded over atop the roe. If one of the flaps has been preprinted with a trade-mark (i.e. flap 76 shown in FIG. 5) then that flap is folded last, to leave the trade-mark prominently displayed and centred within container 100. The container's lid (not shown) is then fastened in place and the container shipped to the customer.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

We claim:

1. A liner for lining a generally rectangular-bottomed container, said liner having a laid-flat configuration comprising:

(a) first and second outer faces connected together along opposed first and second edges and separable from one another along a top edge extending between said first and second edges;

(b) an inwardly gusseted bottom face extending between opposed bottom portions of said first and second edges; and, (c) first and second lines of weakness spaced inwardly from said first and second edges and extending from said top edge, across said outer faces.

2. A liner as defined in claim 1, wherein opposed edges of said bottom face are connected to said bottom portions of said first and second edges respectively.

3. A liner as described in claim 2, wherein said first and second outer faces are further connected to said bottom face along regions which extend diagonally from said first and second edges respectively, in a direction away from said top edge.

4. A liner as defined in claim 3, further comprising a third line of weakness extending between said first and second lines of weakness, beneath said top edge.

5. A liner as defined in claim 1, said liner further having an opened configuration defined by severing said first and second lines of weakness and by separating said first and second faces from one another, wherein:

(a) said bottom face has first, second, third and fourth edges;

(b) said first outer face comprises a first side face and portions of second and fourth side faces connected to and extending upwardly from said first, second and fourth edges respectively; and, (c) said second outer face comprises a third side face and further portions of said second and fourth side faces connected to and extending upwardly from said third, second and fourth edges respectively.

6. A liner as defined in claim 5, wherein:

(a) a lower portion of said first side face is connected to adjacent lower portions of said second and fourth side faces respectively, the remaining portion of said first side face being free of connection to said second, third or fourth side faces;

(b) said lower portion of said second side face is further connected to an adjacent lower portion of said third side face, the remaining portion of said second side face being free of connection to said first, third or fourth side faces;

(c) said lower portion of said third side face is further connected to an adjacent lower portion of said fourth side face, the remaining portion of said third side face free of connection to said first, second, or fourth side faces; and, (d) the remaining portion of said fourth side face being free of connection to said first, second or third side faces.

7. A liner for lining a generally rectangular-bottomed container, said liner having a laid-flat configuration comprising:

(a) a bottom face having first, second, third and fourth edges, said bottom face folded inwardly along an axis parallel to said first and third edges;

(b) first and third side faces connected to and extending upwardly from said first and third edges respectively;

(c) a second side face connected to said bottom face, and further connected between and extending upwardly from first opposed lower portions of said first and third side faces, said second side face folded outwardly from said first and third side faces, along a central axis of said second side face; and, (d) a fourth side face connected to said bottom face, and further connected between and extending upwardly from second opposed lower portions of said first and third side faces, said fourth side face folded outwardly from said first and third side faces, along a central axis of said fourth side face.

8. A liner as defined in claim 7, further comprising:

(a) a first line of weakness connecting said first and third faces to said fourth face; and, (b) a second line of weakness connecting said first and third faces to said second face.

9. A liner as defined in claim 8, wherein:

(a) said first line of weakness further connects said bottom face to said fourth face; and, (b) said second line of weakness further connects said bottom face to said second face.

10. A liner as defined in claim 9, further comprising a third line of weakness extending between said first and second lines of weakness, said third line of weakness for connecting said liner to a support structure.

11. A liner as defined in claim 10, further comprising:

(a) a fourth line of weakness, longitudinally aligned with said first line of weakness, and further connecting said bottom face to said fourth face; and, (b) a fifth line of weakness, longitudinally aligned with said second line of weakness, and further connecting said bottom face to said second face.

12. A liner as defined in claim 7, further comprising:

(a) a first extension of said bottom face connected to said fourth edge and folded inwardly along said axis parallel to said first and third edges, midway between said first and third edges, within said outwardly folded fourth side face; and, (b) a second extension of said bottom face connected to said second edge and folded inwardly along said axis parallel to said first and third edges, midway between said first and third edges, within said outwardly folded second side face.

13. A liner as defined in claim 12, wherein: id first extension is connected to said fourth side (a) said first extension is connected to said fourth side face along a portion of said central axis of said fourth side face; and, (b) said second extension is connected to said second side face along a portion of said central axis of said second side face.

14. A liner as defined in claim 13, wherein:

(a) said first extension is connected to said fourth side face along first and second regions extending diagonally from said central axis of said fourth side face, toward said first and third edges respectively; and, (b) said second extension is connected to said second side face along first and second regions extending diagonally from said central axis of said second side face, toward said first and third edges respectively.

15. A liner as defined in claim 7, said liner further having an opened configuration wherein:

(a) a lower portion of said first side face is connected to adjacent lower portions of said second and fourth side faces respectively, the remaining portion of said first side face being free of connection to said second, third or fourth side faces;

(b) said lower portion of said second side face is further connected to an adjacent lower portion of said third side face, the remaining portion of said second side face being free of connection to said first, third or fourth side faces;

(c) said lower portion of said third side face is further connected to an adjacent lower portion of said fourth side-face, the remaining portion of said third side face free of connection to said first, second, or fourth side faces; and, (d) the remaining portion of said fourth side face being free of connection to said first, second or third side faces.

16. A liner as defined in claim 1, wherein said first and second lines of weakness further extend partially across said inwardly gusseted bottom face.

* * * * *